US007886898B2

(12) United States Patent
Tsakiris

(10) Patent No.: US 7,886,898 B2
(45) Date of Patent: Feb. 15, 2011

(54) SURFBOARD WAX BAR AND APPARATUS FOR PROTECTING SAME

(76) Inventor: Peter Tsakiris, 160 Jefferson Dr., Ocean Township, NJ (US) 07712

( * ) Notice: Subject to any disclaimer, the term of this patent is extended or adjusted under 35 U.S.C. 154(b) by 0 days.

(21) Appl. No.: 12/587,211

(22) Filed: Oct. 5, 2009

(65) Prior Publication Data

US 2010/0084457 A1 Apr. 8, 2010

Related U.S. Application Data

(60) Provisional application No. 61/195,600, filed on Oct. 8, 2008.

(51) Int. Cl.
*A47K 5/08* (2006.01)

(52) U.S. Cl. ..... 206/77.1; 206/459.1; 206/525.1; 229/87.05; 401/52

(58) Field of Classification Search ..... 206/77.1, 206/459.1, 459.5, 525, 525.1, 527, 579; 106/245, 106/268, 270; 229/87.05; 401/52, 82, 124, 401/125; 441/74
See application file for complete search history.

(56) References Cited

U.S. PATENT DOCUMENTS 3,113,666 A * 12/1963 Theodore ..... 229/87.05
3,451,539 A * 6/1969 Wysocki ..... 229/87.05
3,577,258 A * 5/1971 Sincavage et al. ..... 229/87.05
5,219,238 A * 6/1993 Hainbach ..... 401/52
6,764,750 B1 * 7/2004 Claycomb ..... 106/270
2005/0035008 A1 * 2/2005 Nimmey et al. ..... 206/77.1
2006/0248792 A1 * 11/2006 Huxley ..... 47/1.5
2008/0193192 A1 * 8/2008 Zulian ..... 401/52
2009/0013902 A1 * 1/2009 Semasko ..... 106/270

* cited by examiner

*Primary Examiner*—Luan K Bui
(74) *Attorney, Agent, or Firm*—Clifford G. Frayne

(57) ABSTRACT

A surfboard wax bar rectangularly geometric in shape having a plurality of transverse creases or beveled break lines allowing a user to selectively separate a portion of the surfboard wax bar as desired, the surfboard wax bar encapsulated in a protective covering, the protective covering having a plurality of preformed embossed tear lines cooperative and aligned with the transverse creases or beveled break lines of said surfboard wax bar to allow the selective separation of a portion of the surfboard wax bar and associated wrapping, yet not disturb the remaining wrapping and the remaining portion of the surfboard wax bar, the surfboard wax bar and wrapping or portions thereof being stored in a container, the outer surface of which is reflective to the sun, and which is insulated from the heat of the ambient weather so as to prevent deterioration of the surfboard wax bar or any remnants thereof, and also protection from debris such as sand.

20 Claims, 3 Drawing Sheets

SURFBOARD WAX BAR AND APPARATUS FOR PROTECTING SAME

RELATED APPLICATIONS

Applicant claims the benefit of provisional application Ser. No. 61/195,600, filed Oct. 8, 2008.

BACKGROUND OF THE INVENTION

1. Field of the Invention

The present invention relates to surfboard wax, and in particular, to a reconfigured surfboard wax bar, segmented packaging, storage, and transport system which protects the surfboard wax bar and any remainder thereof when not in use from heat and debris.

2. Description of the Prior Art

Surfboard wax normally comes in the form of a bar which is generally rectangular in shape and slightly smaller than a standard bar of soap, but may come in other geometric shapes such as a cylindrical rod or the like. Reference herein to a surfboard wax bar is understood to include alternate geometric shapes. The surfboard wax bar is typically packaged in a plastic, paper, or cardboard container, the surfboard wax bar typically being of unitary construction.

The surfer in need of wax would remove the surfboard wax bar from its container by removing and discarding any wrapping if it was present. The surfboard wax would then be applied to the board by the user to achieve the desired degree of grip. Any portion not used is subject to melting from direct sunlight or excessive heat and tends to be mixed with other discarded overages causing confusion as to which belongs to a particular temperature formula.

Surfboards come in two major classes, short boards and long boards. The short boards are generally less than 8 feet and the long boards start at around 8 feet and can extend up to 12 feet of more. The longer the board, the more wax is needed to achieve a satisfactory surface. The initial coat of wax for a typical short board would normally require a full bar of a typically sized surfboard wax bar to achieve an evenly distributed well covered surface. A long board may require up to two bars to achieve similar results due to the larger deck area and more demanding use requirements. The long board has superior buoyancy and allows the rider to use more of the board surface, as opposed to the short board, and therefore the waxed surface will become worn over a larger area.

Once the board, either short board or long board is waxed, it only requires wax maintenance or "touch ups" to wax the surface before a surf session, and depending on the length of the surf session, may require a touch up during the session to replace wax that has worn off in the higher contact areas, or wax that has been displaced to an adjacent location of less intent use.

Touch up amounts will vary depending upon the size of the board, but typically is less than a quarter of a bar for short boards, and less than half a bar for long boards.

A complete strip and rewax of a board is typically performed several times a year due to the deterioration of the material quality and performance characteristics of the original wax coat. This is due to several factors, such as environmental exposure or excessive heat, sunlight, salt water, or contamination from sand or dirt which becomes embedded in the wax surface.

Typically, an avid surfer will have all of the equipment and tools that are required for the waxing of a board, the stripping of a board, and the touch up of a board, at his home. The inconvenience lies in the course of a surfing session when some touch up work is required, and the surfer requires a wax bar that is suitable for performing the touch up and has not become contaminated, melted, or otherwise unfit for use. Applicant's proposed surfboard wax bar, together with its protective container, provides sufficient wax which will suffice for a typical heavy use day for either a short board or a long board, and is convenient to store and transport, and protect the surfboard wax even in remote locations.

OBJECTS OF THE INVENTION

An object of the present invention is to provide a novel surfboard wax bar which is segmented in design allowing the selective separability of a portion of the surfboard wax bar for use.

Another object of the present invention is to provide for a novel surfboard wax bar which is encapsulated by a protective cover and the protective cover having embossed tear lines permitting the user access to a selective portion of the surfboard wax bar while allowing the remaining portion of the surfboard wax bar to be protected by the protective covering.

Another object of present invention is to provide for a container for the surfboard wax bar and its wrapping, which container is insulated from solar radiation and insulated so as to prevent the deterioration of the surfboard wax bar or any remnants thereof left after use due to excessive heat.

SUMMARY OF THE INVENTION

A surfboard wax bar geometric in shape having a plurality of transverse creases or beveled break lines allowing a user to selectively separate a portion of the surfboard wax bar as desired, the surfboard wax bar encapsulated in a protective covering, the protective covering having a plurality of preformed tear lines cooperative and aligned with the transverse creases or beveled break lines of said surfboard wax bar to allow the selective separation of a portion of the surfboard wax bar and associated wrapping, yet not disturb the remaining wrapping and the remaining portion of the surfboard wax bar, the surfboard wax bar and wrapping or portions thereof being stored in a container, the outer surface of which is reflective to the sun, and which is insulated from the heat of the ambient weather so as to prevent deterioration of the surfboard wax bar or any remnants thereof, and also protection from debris such as sand.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
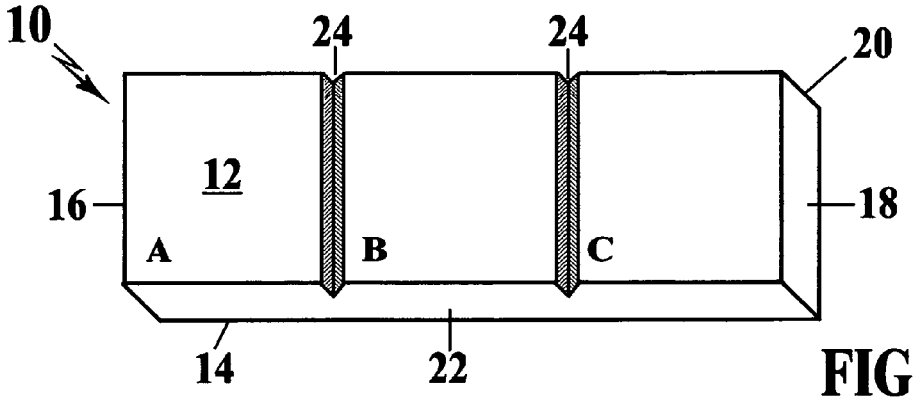
FIG. 1 is a perspective view of a surfboard wax bar of the present invention.

FIG. 1 is a perspective view of the surfboard wax bar 10 of the present invention. The bar is comprised of a surf wax formula molded into a geometric shape generally rectangular as illustrated having an upper surface 12 and lower surface 14, two end walls 16 and 18, and two parallel side walls 20 and 22. Applicant's surfboard wax bar 10 is segmented on its upper surface 12 by a plurality of transverse creases or beveled break lines 24 extending between the parallel side walls 20 and 22 and forming a partial groove between the upper surface 12 and the lower surface 14. The number of creases or beveled break lines may vary depending upon the size of the bar, but in the preferred embodiment, there would be two creases 24 on the upper surface 12 of the bar dividing the bar into three equal segments A, B, and C, which could be broken off for use individually, or in pairs.

Figure 2:
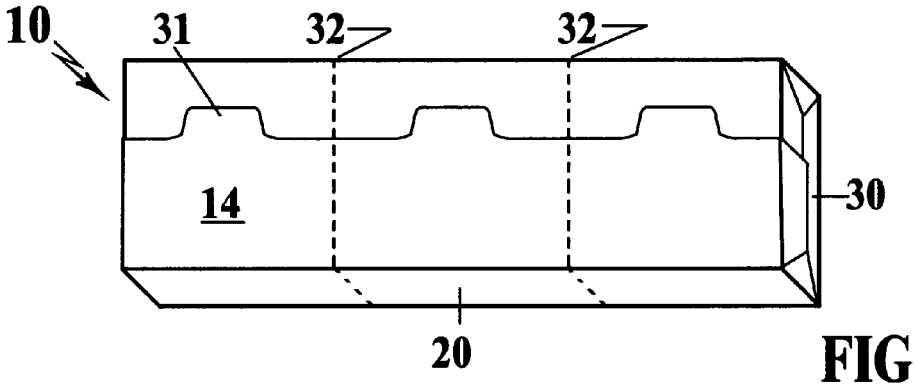
FIG. 2 is a perspective view of a surfboard wax bar of the present invention encapsulated in a protective cover.

FIG. 2 is illustrative of the surfboard wax bar 10 of the present invention encapsulated in a protective cover 30 which in most instances would be a paper or treated paper cover. The cover 30 or treated paper cover which serves as a protective cover would be fabricated with embossed or perforated lines 32 which when wrapped around the surfboard wax bar 10 and secured, would align with the plurality of creases or beveled break lines 24 in the upper surface 12 of the surfboard wax bar 10. This allows the user to identify the location of a certain crease or beveled break line 24 without having to unwrap the protective cover 30 of the entire surfboard wax bar 10.

Figure 3:
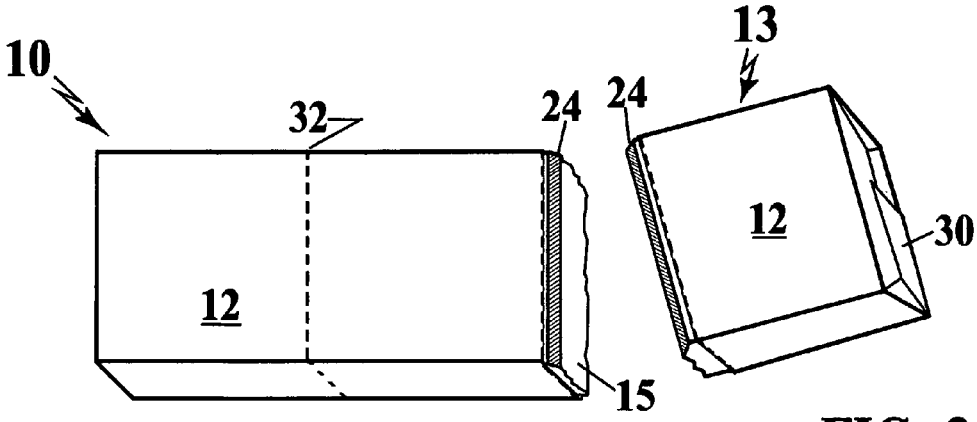
FIG. 3 is a perspective view of the surfboard wax bar of the present invention and its protective cover illustrating the selective separation of a portion of the surfboard wax bar for use.

The user can grasp the surfboard wax bar 10 with the protective cover 30 and selectively unwrap by way of pull tab 31 along embossed or perforated break lines 32 or break the surfboard wax bar along one of the embossed or perforated lines of the protective cover 30 and the underlying crease or beveled break line 24 to obtain the amount of surfboard wax bar that the user desires for a particular purpose. The remainder of the surfboard wax bar 10 remains within the protective cover 30 with the majority of the surfboard wax bar 10 remaining protected. The alternative method of breaking off of the surfboard wax segment bar with the protective cover as described is illustrated in FIG. 3 with the broken or removed end 15 exposed. An advantage of this construction is that the surfer can grasp the portion of the surfboard wax bar 10 that is still encased in the protective wrapper, using it to improve the user's grip and control of the wax bar while applying the exposed segment 13 if still attached, to the deck or the surfboard. If the segment or segments have been detached or broken off of the main bar 10, then that segment/segments can be grasped and applied to the board directly.

Figure 4:
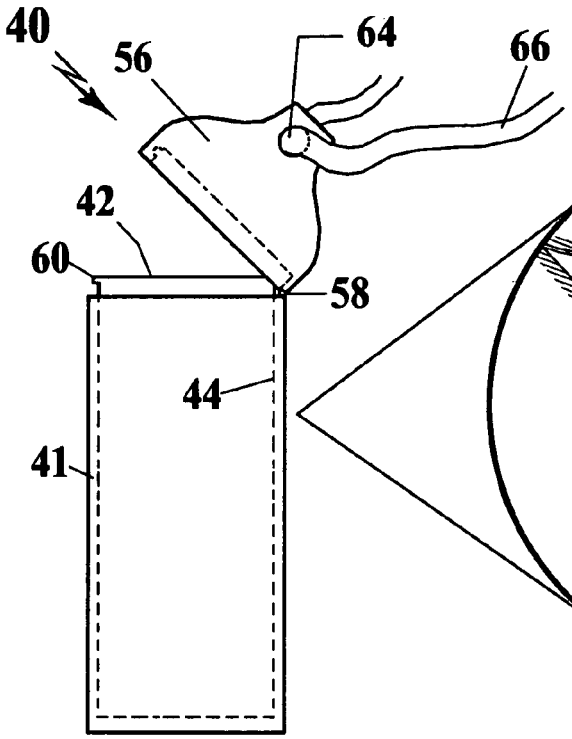
FIG. 4 is a front view of a protective container for storage and transport of the surfboard wax bar in an open configuration.
Figure 6:
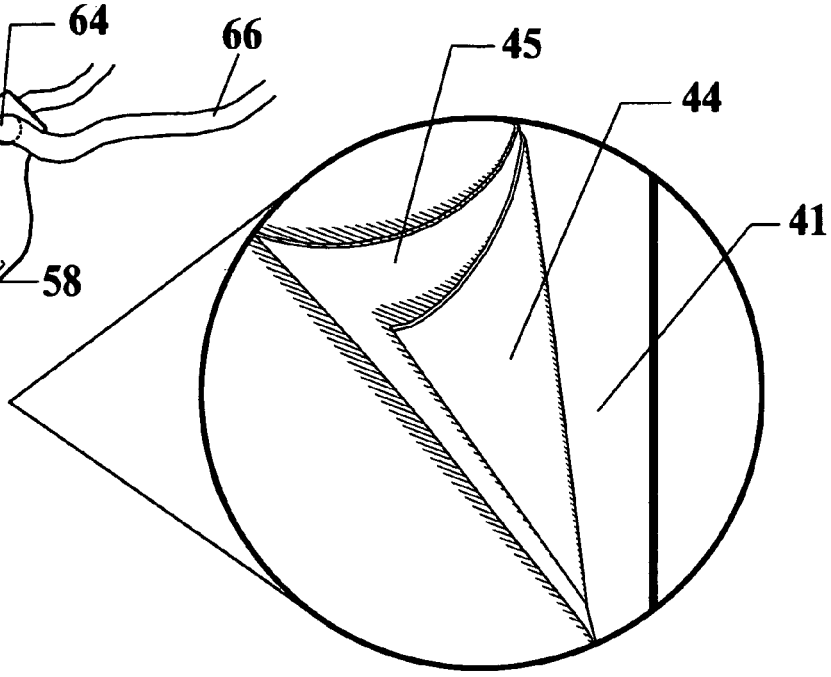
FIG. 6 is a close up view of one embodiment of the sidewall construction of the container.
Figure 5:
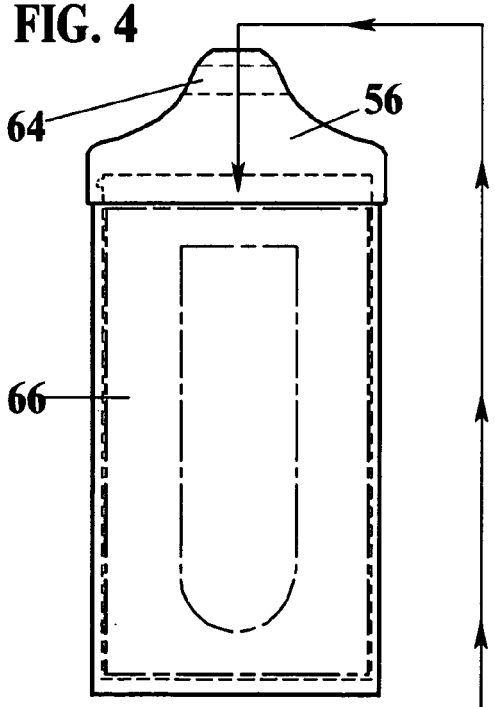
FIG. 5 is a front view of a protective container for storage and transport of the surfboard wax bar in a sealed configuration.
Figure 7:
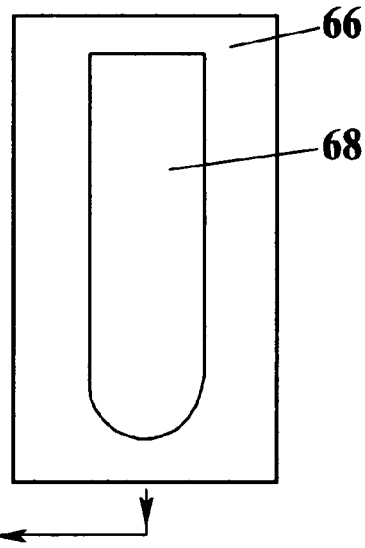
FIG. 7 is a front view of an insert sleeve positionable within the container for ease of removal of the surfboard wax bar or portion thereof.

FIG. 4 is a front view of a protective container 40 for the storage and transport of the surfboard wax bar 10 in an open configuration and FIG. 5 illustrates protective container 40 in a sealed configuration. The container comprises a receptacle portion 42 formed with a rigid side wall 41 which is wrapped on its interior and exterior surfaces with an insulating and solar reflective layer 44 to prevent the receptacle from heating when exposed to sunlight and excessive ambient temperatures (See FIG. 6). A decorative decal 45 can be placed over insulating layer 44. The insulation and solar reflectivity can be achieved by any suitable means including but not limited to adhesive foil, metalized coating, or the like. The receptacle portion 42 is secured with a hinged cover 56 having a hinge 58 and a snap 60 for closure.

An exterior formed aperture 64 on the receptacle portion 42 or cover 56 may be utilized for receipt of a tether rope or braid 66 which allows the user to wear the surfboard wax container and its contents about his/her neck. A sleeve 66 with finger slot 68 is receivable within receptacle 42 for ease of removal of wax bar 10.

Figure 8:
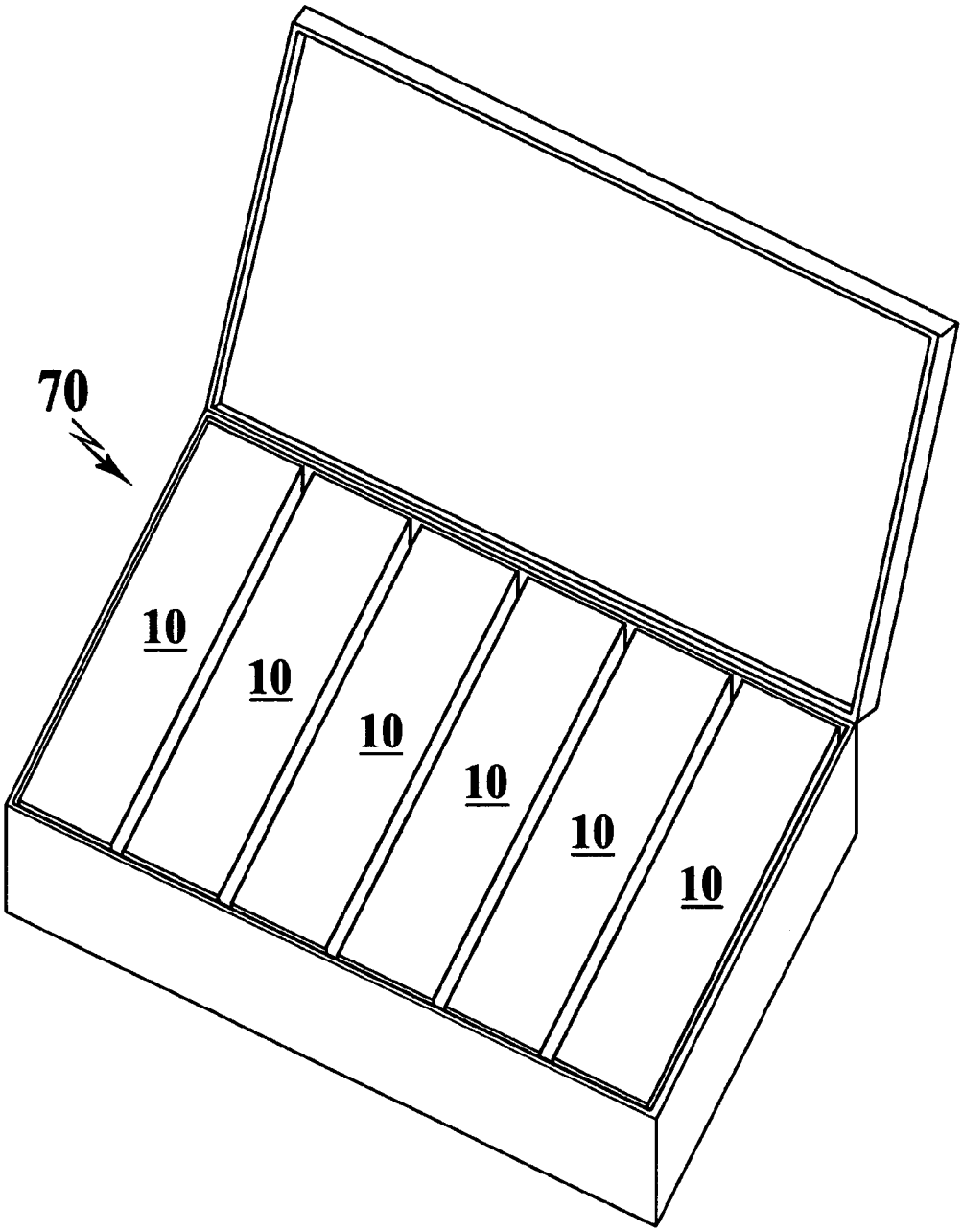
FIG. 8 is a perspective view of a multi surfboard wax container.

Protective container 40 may be refilled with a surfboard wax bar 10 and protective cover 30 from a container 70 as illustrated in FIG. 8 which can hold a plurality of wrapped surfboard wax bars 10, the container 70 having the same insulation and reflective characteristics of container 40.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An improved surfboard wax bar allowing the selective use of a portion of the surfboard wax bar and protection of the unused remainder, the surfboard wax bar comprising:

a surfboard wax bar defined by upper and lower surfaces, longitudinal side walls and lateral end walls, said upper surface having parallel depression grooves extending between said longitudinal side walls to define segmented, separable portions of said surfboard wax bar;

a protective cover wrap encapsulating said surfboard wax bar, said protective cover wrap having an indicia thereon, said indicia in the form of parallel tear lines, said parallel tear lines in registration with said parallel depression grooves in said upper surface of said surfboard wax bar, said parallel tear lines extending about said protective cover wrap, said indicia identifying said underlying depression groove to a user of said surfboard wax bar.

2. An improved surfboard wax bar in accordance with claim 1 wherein said indicia on said protective cover wrap and said parallel depression grooves cooperate to define a snap break separation of a segment of said surfboard wax bar and associated protective cover wrap from said surfboard wax bar along said depression grooves, underlying said indicia on said protective cover wrap for use of said segment of said surfboard wax bar on a surfboard, allowing the remainder of said surfboard wax bar to remain substantially encapsulated by said protective cover wrap.

3. The improved surfboard wax bar in accordance with claim 1 wherein a protective cover wrap pull tab is integrally formed on said protective cover wrap adjacent each of said parallel tear lines facilitating the tearing of said protective cover wrap along said tear line about said surfboard wax bar.

4. The improved surfboard wax bar in accordance with claim 1 wherein said surfboard wax bar is generally rectangular in configuration.

5. The improved surfboard wax bar in accordance with claim 1 wherein said surfboard wax bar is generally cylindrical in configuration.

6. The improved surfboard wax bar in accordance with claim 1 wherein said parallel depression grooves are formed with beveled side walls to facilitate separation.

7. The improved surfboard wax bar in accordance with claim 1 wherein said parallel tear lines on said protective cover wrap are embossed tear lines.

8. The improved surfboard wax bar in accordance with claim 1 wherein said parallel tear lines on said protective cover wrap are perforated tear lines.

9. The improved surfboard wax bar in accordance with claim 1, wherein said protective cover wrap on said segment of said surfboard wax bar removed from said surfboard wax bar provides a gripping surface to the user for application of the surfboard wax.

10. An improved surfboard wax bar and container allowing the selective use of a portion of the surfboard wax bar and protection of the remainder, the improved surfboard wax bar and container comprising:

a surfboard wax bar defined by upper and lower surfaces, longitudinal side walls and lateral end walls, said upper surface having parallel depression grooves extending between said longitudinal side walls to define segmented, separable portions of said surfboard wax bar;

a protective cover wrap encapsulating said surfboard wax bar, said protective cover wrap having an indicia thereon, said indicia in the form of parallel tear lines, said parallel tear lines in registration with said parallel depression grooves in said upper surface of said surfboard wax bar, said parallel tear lines extending about said protective cover wrap, said indicia identifying said underlying depression groove to a user of said surfboard wax bar;

a sealable protective container for the storage, transport, and protection of said surfboard wax bar or portions thereof.

11. The improved surfboard wax bar and container in accordance with claim 10 wherein said indicia on said protective cover wrap and said parallel depression grooves cooperate for identification of a snap break separation of a segment of said surfboard wax bar and associated protective cover wrap from said surfboard wax bar along said depression groove, underlying said indicia on said protective cover wrap for use of said segment of said surfboard wax bar on a surfboard, allowing the remainder of said surfboard wax bar to remain substantially encapsulated by said protective cover wrap.

12. The improved surfboard wax bar and container in accordance with claim 10 wherein said protective cover wrap is formed with a pull tab integrally formed on said protective cover wrap adjacent each of said parallel tear lines facilitating tearing of said protective cover wrap along said tear line about said surfboard wax bar.

13. The improved surfboard wax bar and container in accordance with claim 10 wherein said surfboard wax bar is generally rectangular in configuration.

14. The improved surfboard wax bar and container in accordance with claim 10 wherein said surfboard wax bar is generally cylindrical in configuration.

15. The improved surfboard wax bar and container in accordance with claim 10 further comprising said container having an open securable end, and dimensioned for the slidable receipt of said surfboard wax bar or segmented portion separable thereof when not in use.

16. The improved surfboard wax bar and container in accordance with claim 10 wherein said open securable end of said protective container is formed with a hingeable lid.

17. The improved surfboard wax bar and container for protecting same in accordance with claim 10 further comprising said container having an open securable end, and dimensioned for the slidable receipt of said surfboard wax bar or segmented portion separable there from when not in use.

18. The improved surfboard wax bar and container in accordance with claim 10 wherein said protective container is insulated for heat protection to said surfboard wax bar, said protective container is further light reflective on its exterior surface to prevent heat absorption.

19. The improved surfboard wax bar and container in accordance with claim 10 wherein said protective container is formed with a flexible tether connector to allow the protective container to be worn about the neck of the user.

20. The improved surfboard wax bar and container in accordance with claim 10 wherein said protective container is formed with an internal finger engageable sleeve to facilitate removal of said surfboard wax bar or portions thereof from said container and to prevent accumulation of wax in said container.

* * * * *